United States Patent [19]

Clark et al.

[11] 4,141,796

[45] Feb. 27, 1979

[54] COKE OVEN EMISSION CONTROL METHOD AND APPARATUS

[75] Inventors: Howard E. Clark, Valparaiso; Norman D. Hodgson, Westville, both of Ind.

[73] Assignee: Bethlehem Steel Corporation, Bethlehem, Pa.

[21] Appl. No.: 822,858

[22] Filed: Aug. 8, 1977

[51] Int. Cl.[2] ..... C10B 39/14; C10B 33/00

[52] U.S. Cl. ..... 201/39; 105/271; 105/272; 202/227; 202/263; 214/18 R

[58] Field of Search ..... 202/227, 262, 263; 201/39, 41; 105/261 R, 270, 271, 272, 273, 274; 214/18 R, 41 R

[56] References Cited

U.S. PATENT DOCUMENTS

| | | | |
|---|---|---|---|
| 1,621,871 | 3/1927 | Burner et al. | 105/270 |
| 3,785,933 | 1/1974 | Edgar et al. | 202/263 |
| 3,887,438 | 6/1975 | Kulakov et al. | 202/263 X |
| 4,053,068 | 10/1977 | Gidick | 214/18 R |

*Primary Examiner*—Morris O. Wolk
*Assistant Examiner*—Arnold Turk
*Attorney, Agent, or Firm*—Joseph J. O'Keefe; Michael J. Delaney; Anson W. Biggs

[57] ABSTRACT

Method and apparatus for receiving and transporting hot coke in a coke oven pushing operation and controlling emissions resulting therefrom comprising a one spot quench car having a receptacle which is tiltable to a coke receiving position, a travel and quench position, and a coke discharging position. A hood structure is provided to confine the gases during pushing and a collecting main removes the gases to a remote location for cleaning thereof.

11 Claims, 6 Drawing Figures

COKE OVEN EMISSION CONTROL METHOD AND APPARATUS

BACKGROUND OF THE INVENTION

Concern over environmental pollution has resulted in much activity by industries which manufacture coke to find a coke handling system that minimizes emissions of gaseous and particulate material into the surrounding atmosphere during the pushing cycle of a coke oven operation.

In a conventional quenching operation the quench car is moved along the battery on tracks in front of an oven and receives the hot coke contents of the oven and transports it to a quenching station where a quenching liquid is applied to the hot coke. The quenched coke is then moved to a coke wharf or coke receiving area where the quenched coke is discharged. The conventional quench car has a sloping bottom to aid in discharging the quenched coke and also has an open top. A coke guide is provided to direct the coke cake as it is pushed from the oven into the open top quench car.

Several difficulties arise from the conventional pushing and quenching operation which effect the control of emissions into the atmosphere and the quality of the coke produced. These difficulties include the inability of quench car operators to obtain a uniform and repeatable operation of a moving quench car so that a nearly constant corss-section of coke is obtained from one end of the car to the other. Quench car operators have found that synchronization of the rate of pushing of coke from a coke oven with the quench car movement is extremely difficult and the spread of the hot coke in the car varies from push to push as well as from operator to operator. The one spot car has been developed to overcome this difficulty, insuring the same coke configuration in the car time after time.

Hoods have been designed to cover the quench car and coke guide to capture much of the escaping pollutants. However, known hood designs have not successfully dealt with the infiltration of air into the hoods because of poor fit. Attempts to seal the areas of contact between the hood and car to reduce this infiltration have not been successful. Movement of the loaded quench car beneath the hood is restricted unless means is provided for first moving the hood out of the way.

SUMMARY OF THE INVENTION

It is an object of this invention to provide an improved method to effectively remove emissions in a coke pushing operation.

It is another object of this invention to provide apparatus for collecting the emissions from a coke pushing operation having positive sealing means to reduce infiltration of air.

It is a further object of the invention to provide a one spot coke quench car designed to allow for unobstructed movement along its tracks.

The instant invention accomplishes these objects by providing a one spot car having a receptacle thereon which is tiltable about the longitudinal axis of the car to three positions, viz; (1) coke catching or receiving position, (2) travel and quench position, the (3) coke discharge position. The instant invention provides a hood which encloses the entire top of the coke quench car receptacle and the coke guide to capture emissions therein with means removably attached to a collecting main mounted along the coke oven battery for withdrawing and cleaning the emissions. A floating gravity seal bar is mounted on the lower side surfaces of the hood to engage the tiltable receptacle as it is rotated inwardly toward the oven to a coke catching or receiving position to effect a positive seal between the top of the receptacle and the hood.

DESCRIPTION OF THE PREFERRED EMBODIMENT

Figure 1:
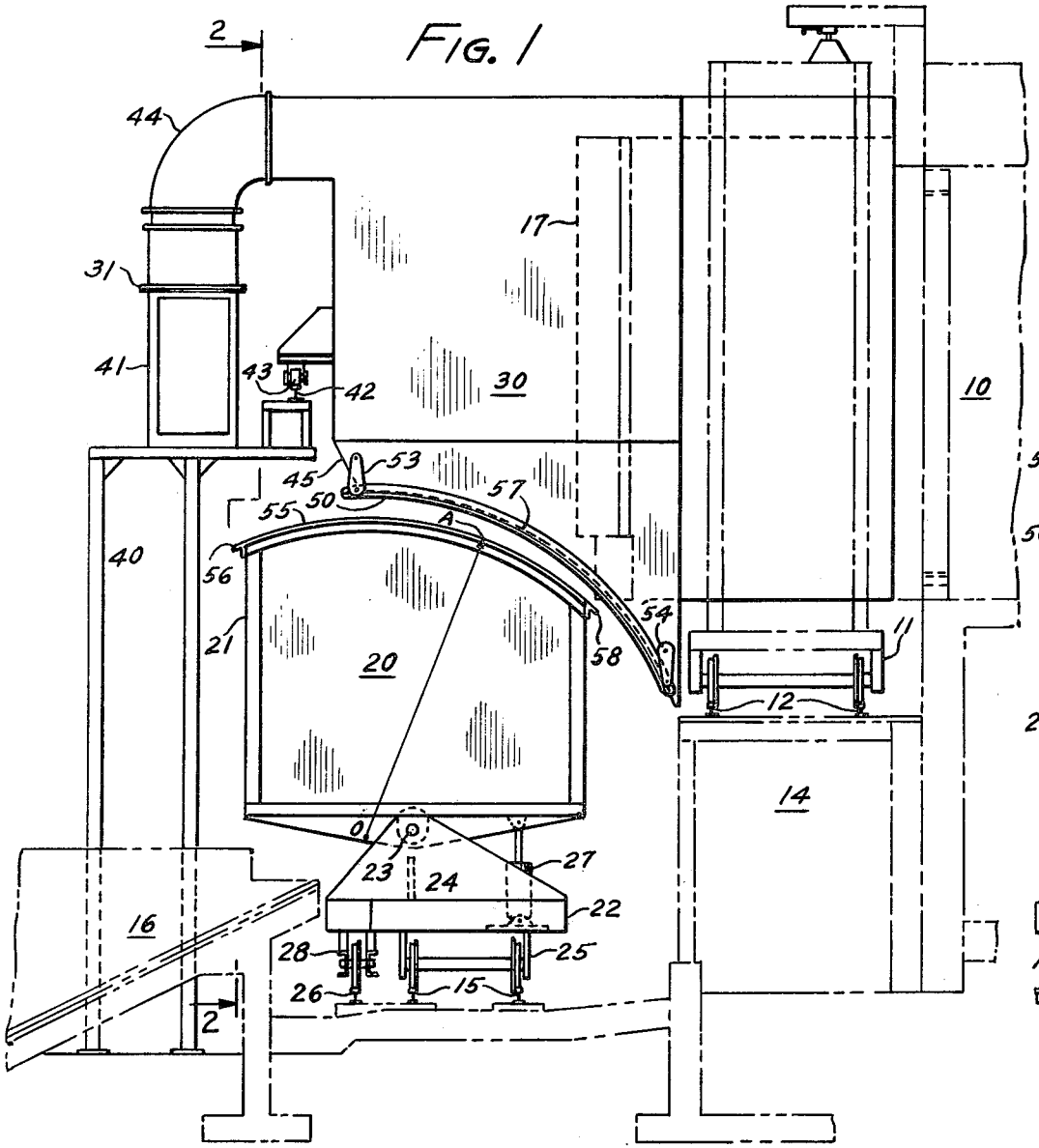
FIG 1 is a side elevation of the car and hood of the invention showing the car in travel position.

Referring now to the drawings and particularly to FIG. 1, a portion of a coke oven chamber 10 is seen with coke guide car 11 positioned in front of oven 10 and aligned with the door opening thereof. The coke guide car 11 is mounted on rails of coke guide track 12 on coke bench 14 for movement along the bench side of the coke oven battery. The quench car track 15 is located at a level below the coke guide track 12 between the bench 14 and coke wharf 16.

Figure 2:
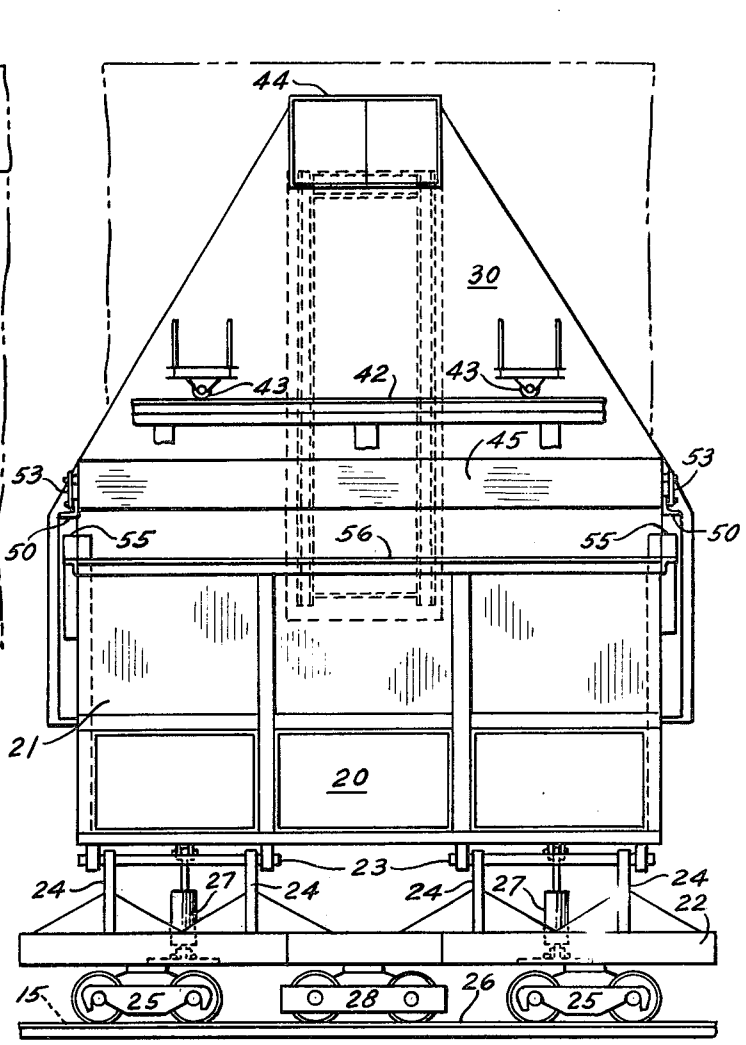
FIG. 2 is an elevational view of the car and hood taken along line 2—2 of FIG. 1.
Figure 6:
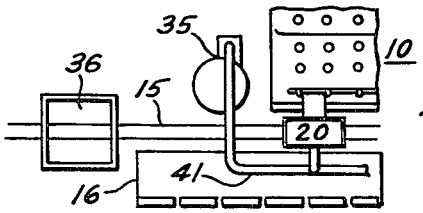
FIG. 6 is a schematic diagram of the installation according to the invention.

Referring to FIGS. 1 and 2, the one spot quench car 20 of this invention is mounted on rails of track 15 adjacent to the coke guide rails having a coke receptacle 21 thereon with means to tilt the receptacle to coke receiving, travel and quench and coke discharging positions or modes and having a hood 30 thereabove. Structure 40 is provided for supporting collecting main 41 which runs parallel to the quench car tracks and carries the gas emissions to remotely located gas cleaning equipment 35, FIG. 6. Also located on this structure 40 is a rail 42 running parallel to, and coextensive with, the coke guide track 12 for a purpose which will be presently described. A hood structure 30 to enclose the top of coke receptacle 21 and coke guide 17 is supported on rail 42 by means of rollers 43 mounted on hood 30 outwardly from the coke bench 14. Hood 30 completely covers the top opening of quench car 20 coke receptacle 21 and encloses coke guide 17. Hood 30 is supported on the coke guide car 11 at the bench end of the hood 30. Coke guide 17 is movable toward and away from the coke oven 10, as is well known, within the hood 30. Hood 30 is connected to collecting main 41 by means of a retractable connection 31.

Referring to FIGS. 1 and 2, the one-spot quench car 20 mounted on rails 15 comprises a substantially rectangular tiltable coke receptacle 21 mounted on a carriage 22 with means to tilt the coke receptacle 21 to three positions, viz.; (1) a coke receiving position, FIG. 3, (2) a travel and quench position, FIG. 1, and (3) a coke discharging position, FIG. 4. Coke receptacle 21 is mounted for rotation about axles 23 mounted longitudinally on quench car 20. The axles 23 are supported on frames 24 which are fixedly mounted on carriage 22.

Carriage 22 is designed to travel on car trucks 25 on track 15. Stabilizing means, as e.g., an additional outrigger truck 28, extending normal to the longitudinal axis of quench car 20 is provided on the wharf side of the quench car to accommodate the shifting center of gravity of the rotating coke receptacle 21 on car 20 as will be understood. Truck 28 is supported on rail 26 which is parallel to, and coextensive with, quench car track 15.

The mechanism for tilting the coke receptacle 21 about axles 23 comprises hydraulic cylinders 27 mounted to raise or lower the coke receptacle 21 to the desired position as hereinbefore described. A fail safe interlock system (not shown) is provided to mechanically lock the tiltable coke receptacle 21 in the desired position as by insertion of pins in a series of holes. The actuator for the mechanical lock is interlocked with the hydraulic system to prevent accidental movement of the car receptacle while in any one of the three desired positions.

Referring to FIG. 1, means to collect the emissions generated during the pushing of the coke oven includes the hood structure 30 which encloses the top of the coke receptacle 21 and the coke guide 17 and exhaust means 44 to carry the gaseous emissions away from the area through collecting main 41 to the gas cleaning equipment 35. Retractable telescopic connection piece 31 is provided to connect exhaust means 44 to collecting main 41. Collecting main 41 carries the gaseous emissions to a remotely located gas cleaning station 35. The hood structure 30 is supported on coke guide car 11 adjacent the bench side of the coke oven battery and outwardly therefrom on rail 42 on the wharf side, which rail is parallel to, and coextensive with, the coke guide track 12 and which is supported on structure 40. Structure 40 also supports the collecting main 41.

Figure 5:
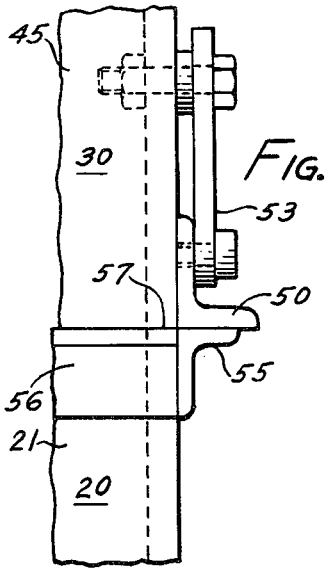
FIG. 5 is an enlarged fragmentary detail of the gravity bar sealing arrangement taken on line 5—5 of FIG. 3.
Figure 3:
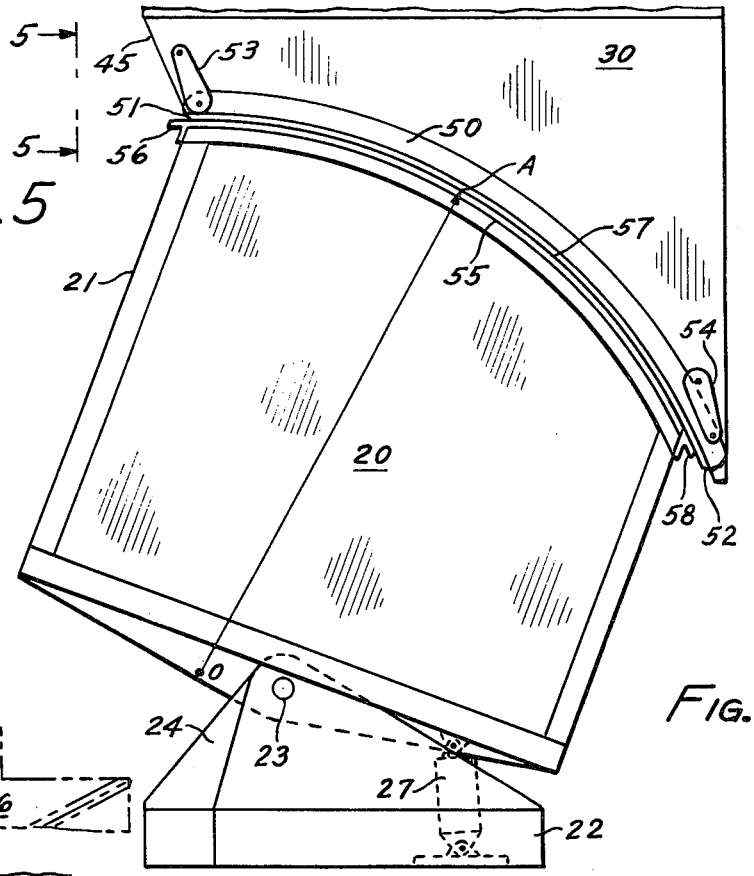
FIG. 3 is an enlarged fragmentary view of a portion of the apparatus showing the coke receptacle rotated to a coke receiving position.
Figure 4:
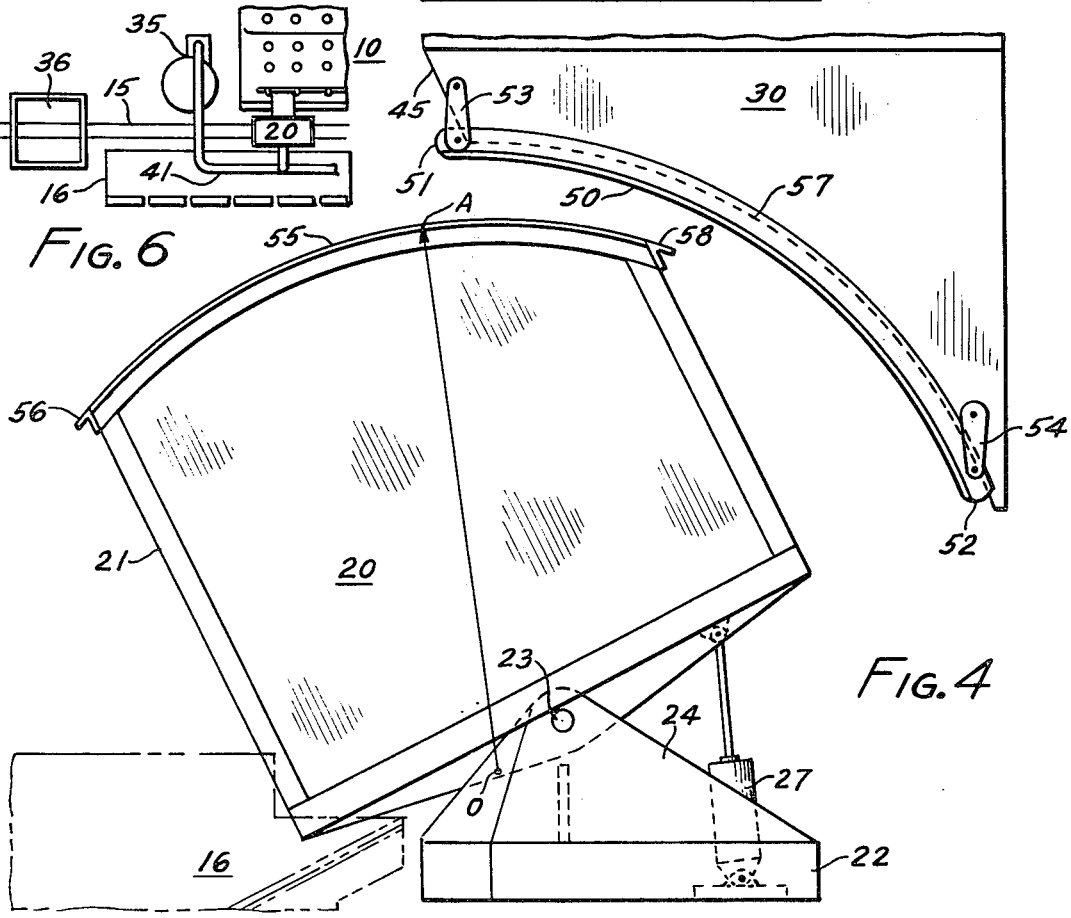
FIG. 4 is an enlarged fragmentary view similar to FIG. 3 showing the coke receptacle rotated to a coke discharging position.

As shown in FIG. 3, the bottom portion of hood 30 is open to align with the top opening of coke receptacle 21 so that as the oven is pushed the contents thereof are confined to the car and the gases emitted are collected in the hood. Means actuated by the tilting of the coke receptacle 21 to the coke receiving or catching position sealingly engages the hood structure with the receptacle as will be clearly understood from the following description. In order to establish a tight seal against air infiltration a movable gravity seal bar 50 is mounted at the bottom edge 57 of each end of hood 30. Seal bar 50 comprises a structural shape, e.g. an angle bar 50 pivotally attached at its ends 51 and 52 to one end of link bars 53 and 54 respectively. The link bars 53 and 54 are pivotally attached at their other ends to the hood 30 end plates as seen in FIGS. 3, 4 and 5. Some misalignment of the coke receptacle 21 with the hood structure 30 is provided for by the width of the angle seal bar 50 with relation to the top members 55 of the coke receptacle.

Referring to FIGS. 1, 3 and 4, the top end member 55 of coke receptacle 21 is formed into a circular arc having a radius "OA". The bottom edge of gravity seal bar 50 is formed with an identical matching circular arc. The center "O" for the circular arc 55 is on the coke discharging or wharf side of the axle 23. Such location for center "O" of the circular arc 55 is necessary for the receptacle 21 to clear the hood 30 when rotated away from the bench toward the wharf or coke discharging position as will be understood by those skilled in the art.

In operation: As an oven in a coke oven battery is ready for pushing a door machine (not shown) removes the door from an oven and the coke guide car 11 moves the coke guide into position in alignment with the opening in the coke oven. The hood structure 30 which is integral with the coke guide and car is likewise in position in front of the opening in the coke oven and the retractable telescopic connection piece 31 is closed onto the collecting main 41. One-spot quench car 20, with coke receptacle 21 in the quench and travel position or mode as shown in FIG. 1, is moved under the hood 30 in alignment with the coke oven to be pushed. The unique design of the one-spot quench car 20 allows adequate clearance for the quench car 20 with coke receptacle 21 thereon to pass underneath the hood structure 30 when the coke receptacle 21 is in the travel or quench position or mode. The operator locks the brakes of the quench car in the desired location and rotates the coke receptacle 21 toward the bench 14, about 20° to the horizontal, to the position shown on FIG. 3. The top structure or end members 55 of the coke receptacle 21 contact the free hanging gravity seal bar 50 as the coke receptacle rotates. When the limit of rotation is reached the closure is complete with the top end members 55 of coke receptacle 21 and the seal bar 50 in sealing engagement. Coke receptacle 21 top side member 56 matches the front lower plate 45 of hood 30 to provide a seal there. A closure member may be provided at the bottom of hood 30 to mate with top side member 58 of coke receptacle 21 if desired. However, the infiltration of air at this point is regarded as minimal and may be advantageous.

The push is made and the remote cleaning station 35 draws the gases emitted during the push and collected in hood structure 30 through collecting main 41. When the push is complete the operator rotates the coke receptacle 21 toward the wharf to return the coke receptacle 21 to the travel and quench position or mode as shown in FIG. 1. The coke receptacle 21 is locked in this position by means of a fail safe interlock system (not shown) to prevent the car from accidentally tilting while in travel. The quench car 20 and contents are moved to the quench station 36 for quenching. When the quench is completed the car is moved to the wharf 16 where it is dumped by rotating the coke receptacle 21 toward the wharf 16 about 28° to the horizontal to the position shown in FIG. 4.

The major function of a coke quenching car, whether it be of conventional or single spot design, is to receive hot coke from a pushed oven, transport the coke to the quench station, and then finally transport the coke to and deposit it on a wharf.

The unique design of this quench car has three (3) operating positions. The first is a vertical upright position or travel mode shown in FIG. 1. In this mode, there is no interference or chance of collision with any other piece of battery machinery. The second mode is the catching or receiving mode shown in FIG. 3. In this mode, the coke receptacle is rotated toward the oven approximately 20°. During this rotation, the free hanging seal plates of the hood shown in FIGS. 3 and 4 are moved into position by the force of the coke receptacle against them. This provides the desired seal between the hood and the coke receptacle. The third position is the dump mode shown in FIG. 4. In this mode, the coke receptacle is rotated toward the wharf about 28°. During this rotation, mechanical linkages automatically open the discharge gates and allow the coke to flow onto the wharf.

This single spot design has several advantages over the conventional quench car. The first is improved coke distribution. Under the present system, coke distribution varies from push to push and from operator to operator. A single spot car which does not move during the push eliminates operator variations and provides a repeatable coke distribution. This uniformity improves the quenching practice and coke quality.

Another advantage of the one spot concept is the ability to seal the emission capture hood 30 to the coke receptacle 21. This feature allows the minimization of infiltrated air and thus reduces fan sizes and operating costs. With the conventional car, clearance must be maintained between the hood and the car so that the car can pass under the hood as the coke is being pushed.

We claim:

1. Apparatus located on the bench side of a coke oven battery for receiving hot coke pushed from a coke oven in the coke oven battery and transporting the coke to a quench station for quenching and thereafter to a coke wharf for discharging the coke thereon and collecting emissions resulting during the pushing cycle, comprising:

(a) a coke guide mounted on rails for movement along the bench side of the coke oven battery, (b) a one spot quench car mounted on rails adjacent to the coke guide rails having a coke receptacle thereon with a top opening for admitting the hot coke, with means to tilt the receptacle towards a coke oven to be pushed to a coke receiving position, maintain the receptacle in a vertical upright travel and quench position, and tilt the receptacle towards the coke wharf to a coke discharging position, (c) a hood structure mounted on the coke guide to enclose the top opening of the quench car and the coke guide when the coke receptacle is in a coke receiving position, (d) means actuated by the tilting of the coke receptacle to the coke receiving position to sealingly engage the hood structure with the coke receptacle, and (e) means to collect emissions generated within said hood structure during the pushing of the coke oven.

2. The apparatus according to claim 1 wherein the hood structure described in subparagraph (c) is supported on the coke guide adjacent the bench side of the coke oven battery and outwardly therefrom on a rail which is parallel to and coextensive with the coke guide rails.

3. The apparatus according to claim 1 wherein the means to sealingly engage the hood structure with the coke receptacle as described in subparagraph (d) includes movable seal bars mounted on the hood structure.

4. The apparatus according to claim 1 wherein the means to collect the emissions described in subparagraph (e) comprises a gas collecting main extending along the bench side of the coke battery and a retractable connection between the hood structure and the collecting main.

5. The apparatus according to claim 2 wherein the means to sealingly engage the hood structure with the coke receptacle as described in subparagraph (d) includes movable seal bars mounted on the hood structure.

6. Apparatus located on the bench side of a coke oven battery for receiving hot coke pushed from a coke oven in the coke oven battery and transporting the hot coke to a quench station for quenching and thereafter to a coke wharf for discharging the coke thereon and collecting emissions resulting during the pushing cycle, comprising:

(a) a coke guide mounted on rails for movement along the bench side of a coke oven battery, (b) a quench car mounted on rails adjacent to the coke guide rails with a longitudinal axis parallel to the rails and with a top opening for admitting the hot coke and having stabilizing means supported on a third rail which is parallel and adjacent to the quench car rails, (c) a coke receptacle mounted on the quench car with means to tilt the coke receptacle about an axis of rotation which is parallel to the longitudinal axis of the quench car towards a coke oven to be pushed to a coke receiving position, maintain the receptacle in a vertical upright travel and quench position, and tilt the receptacle towards the coke wharf to a coke discharging position, (d) a hood structure to enclose the top of the coke receptacle and the coke guide when the coke receptacle is tilted to a coke receiving position, (e) means actuated by the tilting of the coke receptacle to the coke receiving position to sealingly engage the hood structure with the coke receptacle, and (f) means to collect emissions generated within said hood structure during the pushing of the coke oven

7. Apparatus according to claim 6 wherein the stabilizing means described in subparagraph (b) comprises an outrigger member extending normal to the longitudinal axis of the quench car and supported on wheel means for traverse along the third rail.

8. Apparatus according to claim 6 wherein the means to sealingly engage the hood structure with the coke receptacle as described is subparagraph (e) includes movable seal bars mounted on the hood structure having the bottom edge thereof formed into a circular arc and a top end member mounted on the coke receptacle formed to have an identical matching circular arc.

9. Apparatus according to claim 8 wherein the circular arc of the top end member has a center which is located below the axis of rotation of the coke receptacle and on the side of the axis of rotation toward the discharging position of the coke receptacle.

10. The method for controlling emissions in a coke oven battery during the pushing of a coke oven therein which comprises the steps of:

(a) positioning a coke guide on the bench side of the coke oven battery adjacent to and aligned with a coke oven to be pushed, (b) providing a quench car on rails adjacent the bench side of the coke oven battery having a tilting coke receptacle thereon to receive the contents of the coke oven, (c) providing a hood structure with movable seal means mounted thereon to enclose the coke receptacle and the coke guide, (d) tilting the coke receptacle toward a coke oven to be pushed to force the coke receptacle against the movable seal means, (e) discharging the contents of the coke oven into the coke receptacle, (f) collecting emissions generated within said hood structure during the pushing cycle of the coke oven, (g) tilting the coke receptacle away from the bench side of the coke oven battery, and (h) positioning the coke receptacle in a travel and quench position.

11. The method as described in claim 10 further including the steps of:

(i) moving the receptacle and contents therein to a quench station, (j) quenching the contents of the receptacle, (k) moving the receptacle and quenched contents to a coke wharf, (l) tilting the coke receptacle in a direction away from the bench side of the coke oven battery, and (m) discharging the quenched contents of the coke receptacle onto a coke wharf.

* * * * *